US007472537B2

(12) United States Patent
Brunk

(10) Patent No.: US 7,472,537 B2
(45) Date of Patent: Jan. 6, 2009

(54) FLYER AND SPINDLE BRAKE ASSEMBLY FOR HANDSPINNING WHEELS

(76) Inventor: Kenneth D. Brunk, 3095 Old 33 Rd., Harrisonburg, VA (US) 22801

( * ) Notice: Subject to any disclaimer, the term of this patent is extended or adjusted under 35 U.S.C. 154(b) by 0 days.

(21) Appl. No.: 11/987,638

(22) Filed: Dec. 3, 2007

(65) Prior Publication Data

US 2008/0127624 A1 Jun. 5, 2008

Related U.S. Application Data

(60) Provisional application No. 60/872,476, filed on Dec. 4, 2006.

(51) Int. Cl.
*D01H 5/28* (2006.01)

(52) U.S. Cl. ..... 57/316; 57/130

(58) Field of Classification Search ..... 57/88, 57/130–132, 316

See application file for complete search history.

(56) References Cited

U.S. PATENT DOCUMENTS

| | | | | | |
|---|---|---|---|---|---|
| 42,661 | A | * | 5/1864 | Hotchkiss | 57/316 |
| 147,200 | A | | 2/1874 | Voegtli | |
| 467,654 | A | * | 1/1892 | Lotz | 57/316 |
| 578,811 | A | | 3/1897 | Burr | |
| 606,890 | A | * | 7/1898 | Kesselring | 57/79 |
| 710,459 | A | * | 10/1902 | Horlacher | 57/1 R |
| 1,821,556 | A | | 9/1931 | Layfield | |
| 2,623,347 | A | | 12/1952 | Bishop | |
| 3,380,238 | A | | 4/1968 | Araki et al. | |
| 3,722,807 | A | | 3/1973 | Swinehart | |
| 3,974,973 | A | | 8/1976 | Lenk et al. | |
| 4,090,347 | A | | 5/1978 | Chapin | |
| 4,137,701 | A | | 2/1979 | Herubel | |
| 4,196,575 | A | | 4/1980 | Novak | |

(Continued)

FOREIGN PATENT DOCUMENTS

DE 3529076 9/1987

(Continued)

OTHER PUBLICATIONS

Website, http://shop.vendio.com/hiramst/item/77276947/?s=1150711201, Ashford Country Spinner Spinning Wheel from Traditions Fiber Arts & Antiques, two pages printed from the internet on Jun. 20, 2006.

*Primary Examiner*—Shaun R Hurley
(74) *Attorney, Agent, or Firm*—Richard C. Litman

(57) ABSTRACT

The flyer and spindle brake assembly for hand spinning wheels includes a cantilevered spindle and flyer assembly extending from a single maiden post. The spindle base is secured in an adjustable brake mechanism installed in the upper end of the maiden. The flyer has a closed distal end with a spindle bearing and yarn orifice. The flyer is urged toward its whorl or drive pulley by a coil spring on the spindle. The flyer is pulled axially outwardly away from the whorl to release the distal end of the spindle therefrom, the flyer then pivoting from the spindle axis for installation or removal of a bobbin or spool on the spindle. The brake mechanism provides extremely fine and accurate adjustment of braking force for the spindle and spool, while the flyer mechanism allows removal and installation of a spool on the spindle without the need for disassembly of components.

19 Claims, 4 Drawing Sheets

U.S. PATENT DOCUMENTS

| | | | | |
|---|---|---|---|---|
| 4,453,677 | A | 6/1984 | Holzer | |
| 4,458,474 | A * | 7/1984 | Lee | 57/71 |
| 4,742,674 | A | 5/1988 | Hauers et al. | |
| 4,762,285 | A * | 8/1988 | Allred | 242/486.9 |
| 2001/0011451 | A1 | 8/2001 | MacHnik | |

FOREIGN PATENT DOCUMENTS

| | | | |
|---|---|---|---|
| GB | 2047281 | | 11/1980 |
| GB | 2062699 | A * | 5/1981 |
| WO | WO 2005/077802 | | 8/2005 |

* cited by examiner

FLYER AND SPINDLE BRAKE ASSEMBLY FOR HANDSPINNING WHEELS

CROSS-REFERENCE TO RELATED APPLICATION

This application claims the benefit of U.S. Provisional Patent Application Ser. No. 60/872,476, filed Dec. 4, 2006.

BACKGROUND OF THE INVENTION

1. Field of the Invention

The present invention relates generally to manually and/or treadle operated spinning wheels. More specifically, the invention relates to a flyer and spindle brake assembly for hand spinning wheels.

2. Description of the Related Art

Hand spinning wheels, i.e., yarn, thread, or other fiber spinning or twisting machines utilizing manual power for their operation, have a lengthy history. Historically, such wheels were used to produce the vast majority of spun fiber material (yarn, thread, and other fiber for cloth, etc.) until the development of large, powered industrial spinning machines. However, such manually powered spinning machines or spinning wheels are still popular today in many parts of the world where electricity or other power is generally not available, or where the use of such power is not desired for some reason. Also, manually powered spinning wheels are popular with a large number of hobbyists who enjoy using such older technology and working with their hands.

Generally speaking, manually operated spinning wheels are compound machines, in that they perform two functions. First, the machine twists the filaments together as they are fed into the machine to produce a twisted yarn, thread, string, cord, or the like. Secondly, as a length of twisted material is produced, the machine is used to take up the twisted yarn onto a spool or bobbin for storage. These two functions are accomplished by a relatively rapidly rotating "flyer" or bail, which at least generally surrounds the spool or bobbin. The flyer is rotated by a drive band extending from the large flywheel (probably the most readily recognizable feature of the classic spinning wheel) and around a smaller "whorl" or flyer drive pulley.

It will be understood that the takeup spool or bobbin is configured to rotate independently of the flyer, which rotates continuously so long as the large flywheel is being rotated (e.g., by a treadle mechanism, or by hand, etc.). When the yarn or cord is being twisted, it is not being taken up on the bobbin. During this portion of the operation, the flyer and bobbin rotate in unison with one another. Thus, even though the yarn or thread is being spun around the bobbin by the rotation of the flyer, it cannot be taken up on the bobbin, as the bobbin is rotating at the same rate. This operation results in a twist being produced in the filaments or fibers, thus producing a twisted yarn, cord, or the like.

When sufficient twist has been imparted to the filaments, they may be stored by winding them onto the bobbin or spool. This is accomplished by changing the rotary speed of the bobbin relative to the constantly rotating flyer, generally by braking the bobbin so that it is rotating more slowly than the flyer. This difference in rotational velocities between the two components, results in the flyer winding the twisted yarn onto the bobbin or spool for storage. When the twisted portion of the yarn has been wound onto the bobbin, the rotation of the bobbin is again matched with the rotation of the flyer, thereby resulting in the twisting of the filaments with no takeup onto the bobbin. The operation is repeated as desired to produce a relatively long length of twisted yarn, thread, cord, or the like.

Conventionally, most spinning wheels utilize an open-ended flyer, i.e., the two arms of the flyer are not connected to one another at their distal ends. This facilitates the removal and installation of the bobbin or spool onto the spindle, but a separate retaining component (e.g., threaded fastener, lateral pin, etc.) is still required to secure the bobbin on the spindle. Moreover, such an open-ended flyer structure is relatively weak in comparison to a closed flyer, which completely surrounds the bobbin. The reason that closed flyers have not proven popular is that up to the development of the present invention, such a mechanism has required additional fastening components, which must be removed in order to remove or replace the bobbin. This requires a fair amount of time for each bobbin removal and replacement, as well as increasing the cost of the mechanism and the chance of losing various small parts.

An example of such an open-ended flyer is found in German Patent No. 3,529,076, published on Sep. 10, 1987, describing an electrically powered tabletop fiber spinning appliance. It appears particularly from FIG. 2 that the drive pulley and belt from the motor must be removed in order to remove or replace the spool or bobbin on the spindle. The device of the '076 German Patent includes two opposed end plates, which support the spindle at each end thereof.

Insofar as the spindle or bobbin brake mechanism is concerned, it is generally desirable to adjust the spindle, or the bobbin rotating on a stationary spindle, with a slight amount of drag or braking force. The tension applied to the yarn by the person spinning is sufficient to prevent takeup of the yarn onto the bobbin, thus resulting in a purely twisting force being applied to the yarn filaments. Relaxation of the tension on the spun yarn or thread allows the brake to slow or stop the bobbin or spindle rotation relative to the flyer, thereby allowing the yarn or thread to be wound upon the bobbin by the flyer for storage of the twisted yarn.

However, in the past it has proven difficult to provide a bobbin or spindle brake that may be easily and precisely adjusted to produce exactly the desired braking force. While a relatively large amount of effort has gone into the development of spindle and/or bobbin brakes for large, automated industrial spinning and winding machines and looms, comparatively little development has occurred in spindle or bobbin brake systems in manually or treadle operated spinning wheels. Conventional bobbin or spindle brakes tend to be relatively primitive devices, and generally fail to provide the required degree of fine adjustment for accurate work.

Thus, a flyer and spindle brake assembly for hand spinning wheels solving the aforementioned problems is desired.

SUMMARY OF THE INVENTION

The flyer and spindle brake assembly for hand spinning wheels includes an adjustably rotating spindle upon which the yarn spool or bobbin is removably installed. The spindle is cantilevered from a single maiden post, with an adjustable spindle braking mechanism disposed in the upper end of the post through which the support end of the spindle passes. The flyer or bail extends around the spindle and any spool or bobbin installed thereon, with the flyer having a closed distal end selectively capturing the distal end of the spindle therein and including an axially disposed yarn orifice or guide beyond the spindle bearing. The attachment base end of the flyer is pivotally secured to a collar or sleeve, which is, in turn, rotationally affixed to the rotating whorl or flyer drive pulley, being driven by the drive belt from the larger diameter flywheel. A coil spring is installed on the spindle between the spool drive mandrel and the flyer attachment collar, the spring urging the collar (and therefore the flyer) toward the maiden post, thereby securing the spindle bearing of the distal end of the flyer about the distal end of the spindle during operation.

The device is used by initially drawing the flyer axially outwardly away from the maiden post by compressing the flyer retaining spring, thereby freeing the distal end of the spindle from the spindle bearing of the flyer. The flyer is then pivoted about its attachment points at the collar, thereby clearing the distal end of the spindle for the installation of a spool or bobbin thereon. The flyer is then repositioned to secure the distal end of the spindle in the spindle bearing of the distal end of the flyer in order to align the components axially with one another. The spindle brake may be adjusted as desired. Spinning operations may then commence, with the rotating flyer twisting the yarn, thread, etc. therearound so long as the bobbin or spool is allowed to rotate in unison with the flyer. When a length of spun yarn or cord has been produced, the tension on the spun material is relaxed, thereby allowing the brake to slow the rotational speed of the spindle and bobbin installed thereon. This results in the spun material being wound upon the relatively slowly spinning or stopped bobbin, as the flyer continues to rotate around the spindle and bobbin. Further tension on the fiber material overcomes the spindle brake, and causes the bobbin and spindle to rotate in unison with the flyer to twist another length of yarn, thread, or similar material. The process is repeated as desired, with the brake mechanism being adjusted as required for optimum operation.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is related to the hand spinning wheel, in particular, a flyer or bail that obviates the need to remove components for access to the bobbin or spool, and a spindle brake device. The flyer and the brake assembly allow the person spinning yarn or thread to remove and replace the bobbin or spool much more rapidly than is the case with conventional systems, and further to more precisely adjust the spindle braking mechanism for more accurate control of the yarn or thread takeup.

Figure 1:
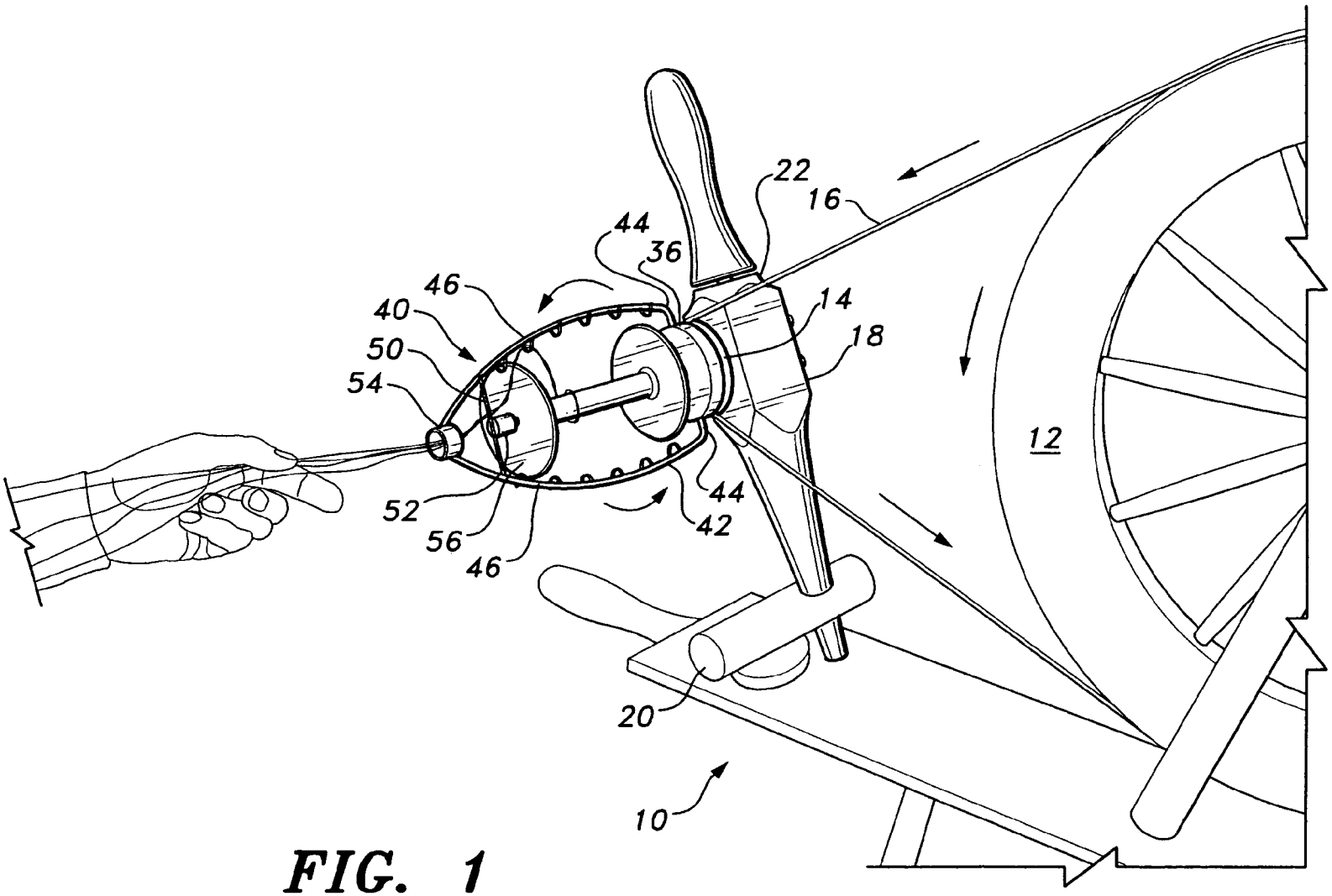
FIG. 1 is an environmental, perspective view of a flyer and spindle brake assembly for hand spinning wheels according to the present invention, showing the spinning and winding operation.

FIG. 1 of the drawings provides an environmental perspective view of a portion of a spinning wheel assembly 10 having the flyer and spindle mechanism of the present invention installed thereon. The spinning wheel 10 includes a conventional flywheel or drive wheel 12, which is typically driven by a conventional treadle and crank system, or alternatively spun by hand, or in some other manner. The drive wheel 12 drives a whorl or spindle pulley 14 by means of a drive belt 16 extending about the partial circumference of the drive wheel 12 and whorl 14.

The whorl 14 extends from the upper end of a single "maiden" or support post 18, which, in turn, extends upwardly from a generally horizontally disposed "mother" support bar 20. The mother bar 20 is adjustably positionable relative to the main wheel 12 in order to adjust the tension on the drive belt 16. Conventionally, the mother bar has two spaced-apart maiden posts extending upwardly therefrom, with the two opposite ends of the spindle being supported by the two opposed maiden posts. This necessitates the disassembly and removal of at least some components whenever the bobbin or spool must be replaced on the spindle. In contrast, the present mechanism utilizes only a single maiden post 18, with the spindle and associated components cantilevered from the single maiden 18.

The maiden post 18 has an upper end 22, which includes a laterally disposed spindle passage 24 and an axial spindle brake passage 26 normal to the spindle passage 24. These passages 24 and 26 are shown most clearly in FIG. 4 of the drawings, and to a certain extent in FIG. 3. The spindle 28 (FIGS. 2 through 4) has a base end portion 30 rotationally disposed within the spindle passage 24 of the maiden post 18, and an opposite distal end 32. An adjustable brake mechanism, e.g., brake assembly 34*a* of FIG. 3 and brake assembly 34*b* of FIG. 4, is disposed within the axial spindle brake passage 26 of the maiden post 18, with the brake mechanism adjustably bearing upon the base end 30 of the spindle 28 to control its rotation.

The whorl pulley 14 is, in turn, installed concentrically upon the spindle 28 adjacent to the maiden post 18, and is free to rotate and slide axially upon the spindle 28. Although the whorl 14 illustrated in FIGS. 1 through 4 of the drawings has only a single pulley groove, it will be understood that the whorl 14 may include multiple pulleys of different diameters to allow the spinning person to adjust the rotational speed of the whorl 14 and flyer relative to the flywheel 12, if so desired. A flyer attachment collar 36 is affixed to the whorl 14, and slides and rotates freely on the spindle 28 with the whorl 14. The flyer attachment collar 36 includes two diametrically opposed, radially disposed flyer arm attachment passages 38 (FIG. 4), which serve to secure the flyer or bail 40 to the collar 36. The flyer 40 has a base portion 42 with a pair of opposed, inwardly directed pins 44 extending therefrom, with the pins 44 engaging the two attachment passages 38 of the flyer attachment collar 36. Thus, the flyer 40 is caused to rotate in unison with the flyer attachment collar 36 and whorl 14 as the flywheel 12 drives the drive belt 16 to spin the whorl 14. The flyer arm pins 44 may be secured to, or retained within, the flyer attachment passages 38 of the collar 36 by conventional keepers or retainers.

A pair of diametrically opposed arms 46 extend from the collar attachment pins 44 of the flyer 40 to a point adjacent the distal end 32 of the spindle 28. The arms 46 preferably each include at least one, and preferably a series of, level winding hooks 48 disposed therealong. A crossmember 50 extends between the distal portions of the two flyer arms 46, with the crossmember 50 having a spindle end bearing 52 disposed centrally therein. The two flyer arms 46 terminate at their distal ends in a yarn orifice 54, with the orifice 54 having an axis A concentric with the spindle end bearing 52. Thus, the orifice 54 is aligned with the axis of the spindle 28 when the spindle end bearing 52 of the flyer 40 is engaged with the distal end of the spindle 28, as shown in FIGS. 1, 3, and 4 of the drawings.

Figure 2:
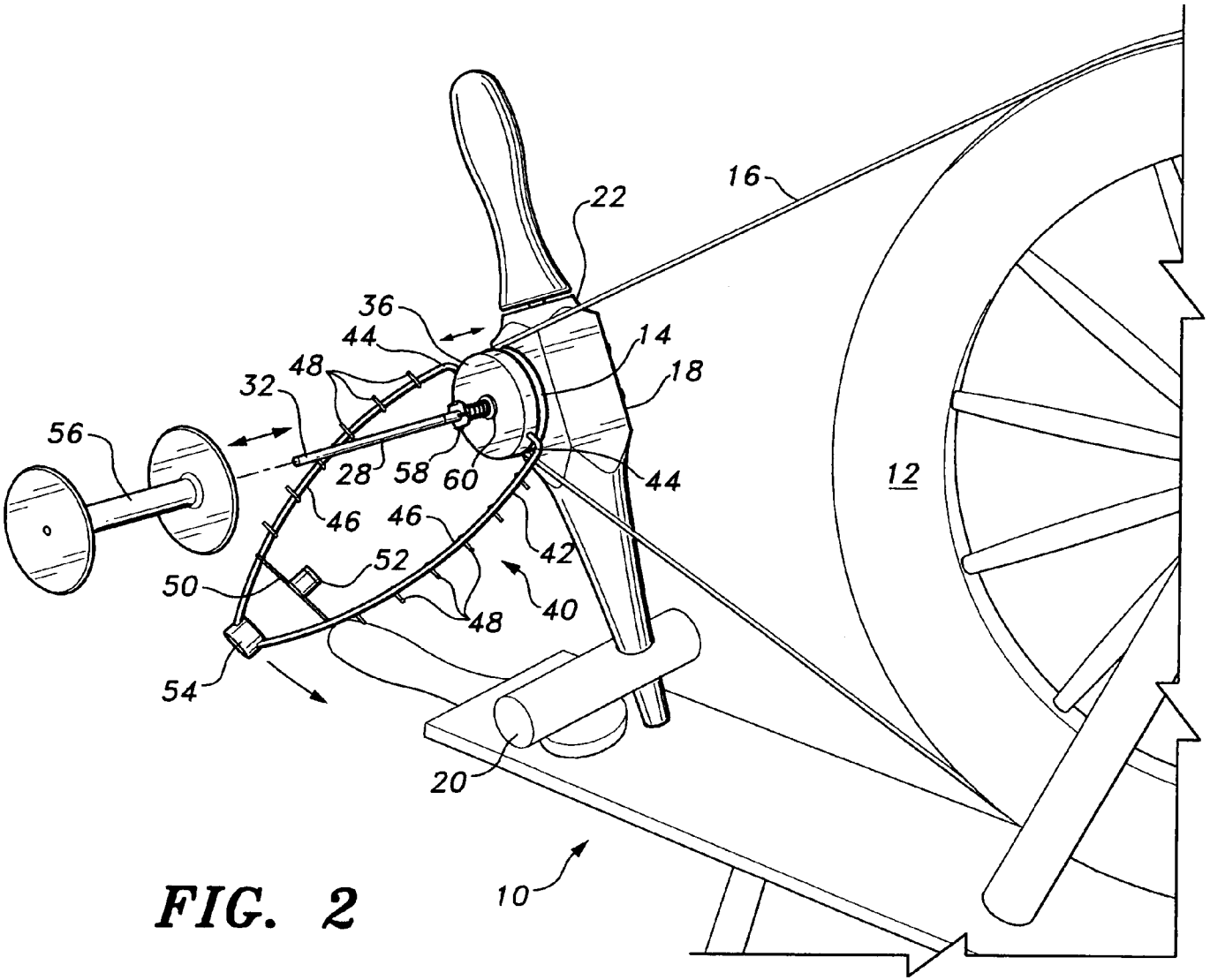
FIG. 2 is a partially exploded perspective view of the assembly of FIG. 1, showing the flyer pivoted away from the distal end of the spindle for removal or installation of a spool or bobbin thereon.

A yarn collection bobbin or spool 56 is removably installed upon the spindle 28, and rotates in unison with the spindle by means of a bobbin drive mandrel 58 immovably and affixed to the spindle 28 for rotation with the spindle 28. A compression spring 60 is disposed upon the spindle 28 between the flyer attachment collar 36 and the bobbin drive mandrel 58. The spring 60 serves to prevent the flyer attachment collar 36, and thus the flyer 40, from sliding axially along the spindle 28 and releasing the spindle end bearing 52 of the flyer 40 from its seated position upon the distal end 32 of the spindle 28. However, the spring 60 is normally not in compression and does not normally bear upon the collar 36 or mandrel 58 until the flyer attachment collar 36 (and its attached whorl 14 and flyer 40) are urged toward the distal end 32 of the spindle 28. This allows the spindle end bearing 52 of the flyer 40 to release from the distal end 32 of the spindle 28, thereby allowing the flyer 40 to pivot radially relative to the spindle 28 rotation of the flyer attachment pins 44 in passages 38, generally as shown in FIG. 2 of the drawings. This allows the spool or bobbin 56 to be removed from the spindle 28 and replaced with another bobbin, as desired. The spindle end bearing 52 of the flyer 40 is reinstalled over the distal end 32 of the spindle 28 to ready the spinning wheel assembly 10 for further spinning. No removal of components or disassembly, other than that described above, is required for removal and replacement of the bobbin 56.

The flyer 40 rotates in unison with the flyer attachment collar 36 and whorl pulley 14, as described further above, when driven by the flywheel 12 and drive belt 16. The rotation of the flyer attachment collar 36 and whorl 14 result in some frictional drag upon the spindle 28, thus urging the spindle and its bobbin 56 captured thereon to rotate in unison with the flyer 40 during the spinning operation. This results in a pure spinning of the yarn or other fiber material, since the rotation of the spindle 28 and bobbin 56 in unison with the flyer 40 cannot wind the yarn onto the bobbin, as there is no relative rotary motion between the bobbin 56 and flyer 40. However, if the rotation of the spindle 28 and its bobbin 56 are slowed or braked relative the rotation of the flyer 40, the difference in relative rotational speeds between the flyer 40 and bobbin 56 will result in the previously twisted yarn or thread being wound upon the bobbin for storage thereon. Accordingly, the winding operation may be controlled by regulating the rotational speed of the spindle 28 and its bobbin 56 relative to the flyer 40.

Figure 3:
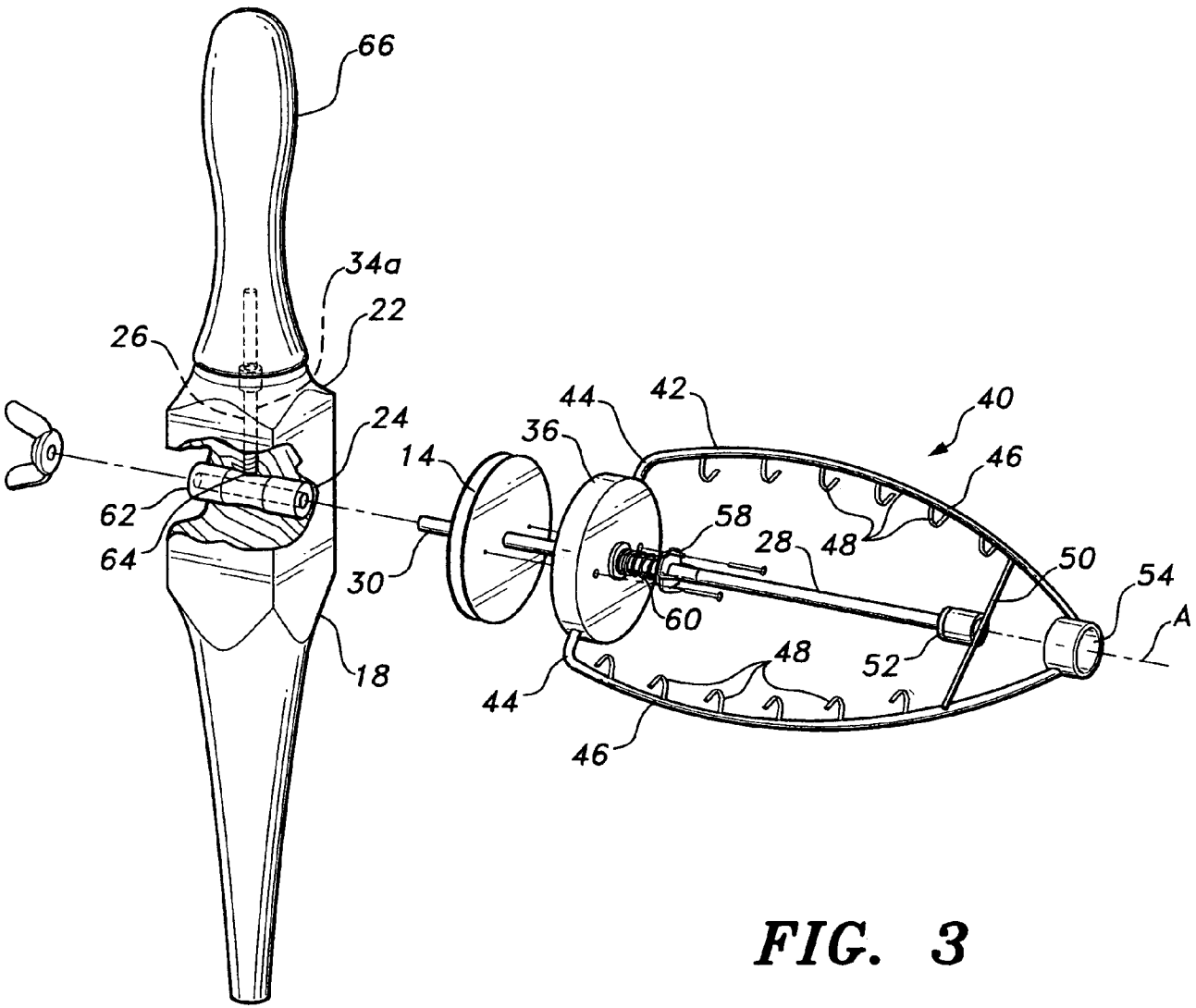
FIG. 3 is an exploded perspective view of the assembly of FIG. 1, showing further details, particularly of the spindle brake assembly.
Figure 4:
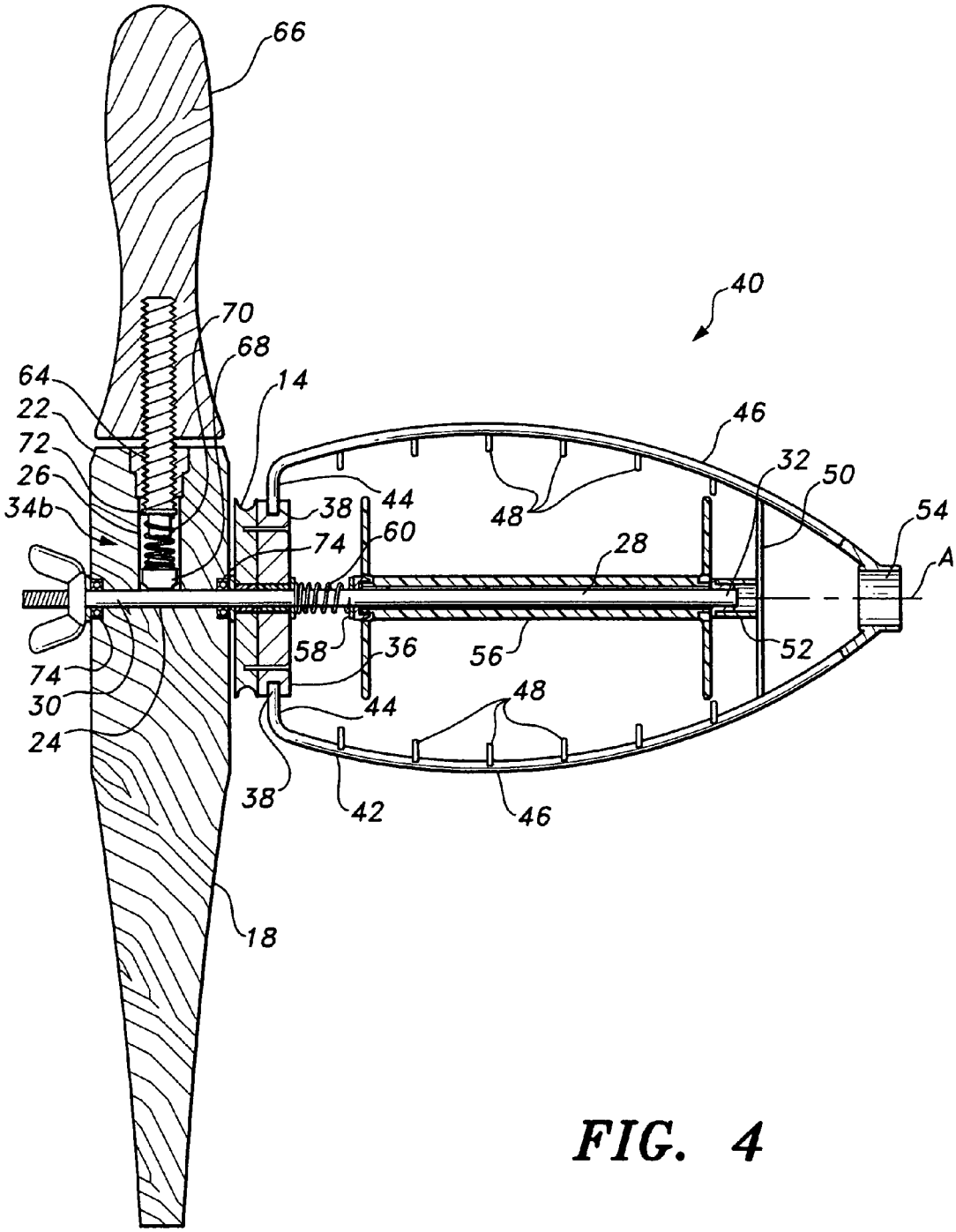
FIG. 4 is an elevation view in section of the flyer and spindle assembly and a second embodiment of the spindle brake assembly according to the present invention.

This may be accomplished by a brake mechanism, e.g., 34*a* of FIG. 3 or 34*b* of FIG. 4, disposed within the upper portion 22 of the maiden post 18, with the brake being adjusted to produce the desired amount of rotational drag upon the base end 30 of the spindle 28 in its spindle passage 24. The brake assembly 34*a* of FIG. 3 comprises a plastic sleeve 62 (e.g., nylon, etc.) installed within the spindle passage 24 of the maiden post 18. The sleeve 62 provides a low friction bearing surface for the base end 30 of the spindle 28 installed therein, but may also be deformed to adjust its friction upon the spindle 28 as desired. A threaded shaft 64 is installed in the spindle brake passage 26 of the maiden post, and bears against the side of the sleeve 62. The threaded shaft 64 is immovably affixed within the brake adjustment handle 66, with the handle 66 rotating relative to the maiden post 18. Turning the adjustment handle 66 clockwise tightens the pressure of the end of the threaded shaft 64 upon the side of the sleeve 62, thereby increasing the frictional pressure on the spindle 28 to restrict its rotation. Loosening the adjustment handle 66 has the opposite effect, freeing the spindle 28 to rotate more easily. A spring, as shown in the brake assembly 34*b* of FIG. 4, may be installed between the end of the threaded shaft 64 and the sleeve 62 to further refine the braking adjustment, if so desired.

The brake assembly 34*b* of FIG. 4 differs in that a plastic brake shoe 68 is installed at the lower end of the brake assembly passage 26 in the maiden post 18, i.e., at the juncture of the brake assembly passage 26 and spindle passage 24. A compression spring 70 is installed between the brake shoe 68 and the lower end of the threaded shaft 64. A cap 72 may be placed between the lower end of the threaded shaft 64 and the spring 70, in order to reduce any asymmetrical adjustment due to rotational forces of the threaded shaft 64 being applied to the brake shoe 68 through the spring 70. The threaded shaft 64 is affixed in the end of a brake adjustment handle 66, as in the brake embodiment 34*a* of FIG. 3. Rotation of the adjustment handle 66 increases or decreases the pressure on the brake shoe 68, thereby adjusting the resistance to rotation of the spindle 28. The brake mechanism 34*b* of FIG. 4, with its spring 70 and brake shoe 68, allows the frictional force upon the spindle 28 to be adjusted extremely accurately, as desired. A pair of ball bearings 74, or other low friction bearing assemblies may optionally be installed within the spindle passage 24 at opposite ends thereof to further reduce friction upon the spindle, as desired.

In conclusion, the flyer and spindle brake assembly for hand spinning wheels greatly facilitates the spinning operation for persons using such devices. The ease of removal and replacement of bobbins by means of the flyer and spindle mechanism of the present invention greatly speeds the operation and reduces the down time when the wheel is not rotating and no spinning is being performed. The spindle brake allows the spinning person to adjust the spindle drag quite accurately, thereby enabling the spinner to achieve precisely the twist desired when spinning yarns and threads of various materials and textures. Accordingly, spinning wheels incorporating the flyer and brake spindle assembly will be much appreciated by those involved in the spinning craft.

It is to be understood that the present invention is not limited to the embodiments described above, but encompasses any and all embodiments within the scope of the following claims.

I claim:

1. A flyer and spindle brake assembly for a spinning wheel, comprising:

a single maiden post having an upper end, the maiden post having a spindle passage disposed laterally therethrough and a spindle brake passage disposed axially therethrough normal to, and communicating with, the spindle passage;

a spindle having a base end portion and a distal end opposite the base end, the base end being rotationally disposed within the spindle passage of the maiden post;

an adjustable spindle brake assembly disposed within the spindle brake passage;

a whorl pulley disposed upon the spindle adjacent the maiden post, the whorl pulley being rotatable and axially slidable on the spindle;

a flyer attachment collar axially slidable and rotationally disposed upon the spindle, the collar being affixed to the whorl pulley, the flyer attachment collar having mutually opposed and radially disposed first and second flyer arm attachment passages therein; and a flyer pivotally attached to the flyer attachment collar, the flyer having a base and a closed distal end opposite the base.

2. The flyer and spindle brake assembly for a spinning wheel according to claim 1, further including:

a brake shoe adjustably bearing upon the base end portion of the spindle within the spindle brake passage of the maiden post;

a brake adjustment screw threadably disposed within the spindle brake passage of the maiden post; and a brake pressure spring captured between the brake adjustment screw and the brake shoe.

3. The flyer and spindle brake assembly for a spinning wheel according to claim 1, wherein said flyer has:

mutually opposed first and second pins extending inwardly at the base of said flyer, the pins pivotally engaging the first and second flyer arm attachment passages of the flyer attachment collar;

diametrically opposed first and second flyer arms extending from the first and second pins of the flyer; and a spindle end bearing disposed concentrically within the distal end of the flyer.

4. The flyer and spindle brake assembly for a spinning wheel according to claim 3, wherein the flyer has a yarn orifice disposed at the distal end of the flyer, the yarn orifice having an axis concentric with the spindle end bearing of the flyer.

5. The flyer and spindle brake assembly for a spinning wheel according to claim 3, further including at least one yarn level winding hook disposed upon each of the flyer arms.

6. The flyer and spindle brake assembly for a spinning wheel according to claim 3, further comprising:

a bobbin drive mandrel immovably affixed upon the spindle; and a coil spring disposed upon the spindle between the flyer attachment collar and the bobbin drive mandrel, the coil spring resiliently retaining the distal end of the spindle within the spindle end bearing.

7. The flyer and spindle brake assembly for a spinning wheel according to claim 1, further including mutually opposed first and second bearing assemblies disposed upon the base end portion of the spindle, the bearing assemblies extending within the spindle passage of the maiden post.

8. A flyer and spindle brake assembly for a spinning wheel, comprising:

a single maiden post having an upper end, the maiden post having a spindle passage disposed laterally therethrough and a spindle brake passage disposed axially therethrough normal to, and communicating with, the spindle passage;

a spindle having a base end portion and a distal end opposite the base end, the base end being rotationally disposed within the spindle passage of the maiden post;

an adjustable spindle brake assembly disposed within the spindle brake passage, the spindle brake assembly having;

a brake shoe adjustably bearing upon the base end portion of the spindle;

a brake adjustment screw disposed within the spindle brake passage; and a brake pressure spring captured between the brake adjustment screw and the brake shoe;

a whorl pulley rotationally disposed and axially slidable upon the spindle adjacent the maiden post;

a flyer attachment collar axially slidable and rotationally disposed upon the spindle, the collar being affixed to the whorl pulley, the flyer attachment collar having mutually opposed and radially disposed first and second flyer arm attachment passages defined therein; and a flyer pivotally attached to the flyer attachment collar, the flyer having a base and a closed distal end opposite the base.

9. The flyer and spindle brake assembly for a spinning wheel according to claim 8, wherein said flyer has:

mutually opposed first and second pins extending inwardly at the base of said flyer, the pins pivotally engaging the first and second flyer arm attachment passages of the flyer attachment collar;

diametrically opposed first and second flyer arms extending from the first and second pins of the flyer; and a spindle end bearing disposed concentrically within the distal end of the flyer.

10. The flyer and spindle brake assembly for a spinning wheel according to claim 9, wherein the flyer has a yarn orifice disposed at the distal end of the flyer, the yarn orifice having an axis concentric with the spindle end bearing of the flyer.

11. The flyer and spindle brake assembly for a spinning wheel according to claim 9, further including at least one yarn level winding hook disposed upon each of the flyer arms.

12. The flyer and spindle brake assembly for a spinning wheel according to claim 9, further comprising:

a bobbin drive mandrel immovably affixed upon the spindle; and a coil spring disposed upon the spindle between the flyer attachment collar and the bobbin drive mandrel, the coil spring resiliently retaining the distal end of the spindle within the spindle end bearing.

13. The flyer and spindle brake assembly for a spinning wheel according to claim 8, further including mutually opposed first and second bearing assemblies disposed upon the base end portion of the spindle, the bearing assemblies extending within the spindle passage of the maiden post.

14. A flyer and spindle brake assembly for a spinning wheel, comprising:

a single maiden post having an upper end, the maiden post having a spindle passage disposed laterally therethrough and a spindle brake passage disposed axially therethrough normal to, and communicating with, the spindle passage;

a spindle having a base end portion and a distal end opposite the base end, the base end being rotationally disposed within the spindle passage of the maiden post;

an adjustable spindle brake assembly disposed within the spindle brake passage;

a whorl pulley rotationally disposed and axially slidable upon the spindle adjacent the maiden post;

a flyer attachment collar axially slidable and rotationally disposed upon the spindle, the collar being affixed to the whorl pulley, the flyer attachment collar having mutually opposed and radially disposed first and second flyer arm attachment passages defined therein;

a flyer pivotally attached to the flyer attachment collar, the flyer having;

a base having mutually opposed first and second pins extending inwardly therefrom, the pins pivotally engaging the first and second flyer arm attachment passages of the flyer attachment collar;

diametrically opposed first and second arms extending from the first and second pins;

a closed distal end opposite the base; and a spindle end bearing disposed concentrically within the distal end, the distal end of the spindle releasably engaging the spindle end bearing to lock the closed distal end of the flyer to the spindle.

15. The flyer and spindle brake assembly for a spinning wheel according to claim 14, wherein the flyer has a yarn orifice disposed at the distal end of the flyer, the yarn orifice having an axis concentric with the spindle end bearing of the flyer.

16. The flyer and spindle brake assembly for a spinning wheel according to claim 14, further including at least one yarn level winding hook disposed upon each of the flyer arms.

17. The flyer and spindle brake assembly for a spinning wheel according to claim 14, further including:

a brake shoe adjustably bearing upon the base end portion of the spindle within the spindle brake passage of the maiden post;

a brake adjustment screw threadably disposed within the spindle brake passage of the maiden post; and a brake pressure spring captured between the brake adjustment screw and the brake shoe.

18. The flyer and spindle brake assembly for a spinning wheel according to claim 14, further comprising:

a bobbin drive mandrel immovably affixed upon the spindle; and a coil spring disposed upon the spindle between the flyer attachment collar and the bobbin drive mandrel, the coil spring resiliently retaining the distal end of the spindle within the spindle end bearing.

19. The flyer and spindle brake assembly for a spinning wheel according to claim 14, further including mutually opposed first and second bearing assemblies disposed upon the base end portion of the spindle, the bearing assemblies extending within the spindle passage of the maiden post.

* * * * *